US009964292B2

(12) United States Patent
Xue et al.

(10) Patent No.: US 9,964,292 B2
(45) Date of Patent: May 8, 2018

(54) ANGLE ADJUSTMENT MECHANISM FOR LED BAR LIGHTING

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Yuanfang Xue, Zhejiang (CN); Zhaoyong Zheng, Zhejiang (CN); Bozhang Xu, Zhejiang (CN); Feng Ji, Zhejiang (CN); Wen Wang, Zhejiang (CN); Chengke Zhang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days. days.

(21) Appl. No.: 15/624,265

(22) Filed: Jun. 15, 2017

(65) Prior Publication Data

US 2017/0370562 A1 Dec. 28, 2017

(30) Foreign Application Priority Data

Jun. 22, 2016 (CN) ..... 2016 1 0470523

(51) Int. Cl.

| | |
|---|---|
| ***F21V 21/00*** | (2006.01) |
| ***F21V 21/14*** | (2006.01) |
| ***F21S 4/28*** | (2016.01) |
| ***F21V 14/02*** | (2006.01) |
| ***F21V 19/02*** | (2006.01) |
| ***F21K 9/65*** | (2016.01) |
| ***F21K 9/272*** | (2016.01) |
| *F21Y 115/10* | (2016.01) |

(52) U.S. Cl.

CPC ..... *F21V 21/14* (2013.01); *F21K 9/272* (2016.08); *F21K 9/65* (2016.08); *F21S 4/28* (2016.01); *F21V 14/02* (2013.01); *F21V 19/02* (2013.01); *F21Y 2115/10* (2016.08)

(58) Field of Classification Search

CPC .... F21K 9/272; F21K 9/65; F21S 4/28; F21V 14/02; F21V 19/02; F21V 21/14; F21Y 2115/10

USPC ..... 362/217.15

See application file for complete search history.

(56) References Cited

U.S. PATENT DOCUMENTS 7,871,180 B2 * 1/2011 Wu ..... F21S 2/00 362/217.13

8,118,447 B2 * 2/2012 Simon ..... F21K 9/175 313/318.01

(Continued)

*Primary Examiner* — Seung Lee

(74) *Attorney, Agent, or Firm* — Wang Law Firm, Inc.

(57) ABSTRACT

An angle adjustment mechanism for LED bar lighting includes a lamp body, two end covers arranged two ends of the lamp body along an axial direction thereof, two lamp frames respectively mounted on the two threading pipes, two wheel gears respectively fixed on the two lamp frames, two outer end caps fixed and covered on the two end covers, respectively, and at least two stopping plates respectively received in the two lamp frames. Each of the two end covers includes a threading pipe extending along the axial direction of the lamp body. Each of the two wheel gears includes a plurality of gear teeth taken along a radial direction thereof and rotating around the threading pipe. Each of the stopping plates provides at least one stopping tooth which is coupling to the gear teeth.

11 Claims, 3 Drawing Sheets

(56) References Cited

U.S. PATENT DOCUMENTS

2007/0133202 A1* 6/2007 Huang ..... F21K 9/65
362/235
2008/0253121 A1* 10/2008 Chien ..... H04N 5/2354
362/249.07

* cited by examiner

ANGLE ADJUSTMENT MECHANISM FOR LED BAR LIGHTING

RELATED APPLICATION

This present application claims benefit of the Chinese Application, CN201610470523.1, filed on Jun. 22, 2016.

BACKGROUND

1. Technical Field

The present application relates to a lighting device, and more particularly to an angle adjustment mechanism for LED bar lighting.

2. Description of the Related Art

Light emitting diode (LED) is growing in popularity due to decreasing costs and long life compared to incandescent lighting and fluorescent lighting. Recently, a number of LED lighting apparatuses have been designed to replace the halogen apparatus, as well as other traditional incandescent or fluorescence lighting apparatuses. In some places such as exhibition halls, jewelry stores, museums, supermarkets, and some home lighting, such as large villas, will use a lot of strip LED lamps. Moreover, in addition to lighting equipments, such as general traffic lights, billboards, motor-lights, etc., also use light-emitting diodes as light source. As described above, for the light-emitting diodes as a light source, the advantage is power saving, and the greater brightness. Therefore, the use has been gradually common.

With the popularity of LED strip lamps, more and more occasions start using LED bar lightings. For supermarkets, shopping malls, museums, exhibition halls and other places, such as cottages, a lot of LED bar lightings are used to illuminate the walls. In some areas such as wall washer, lawn lamp, etc., it is often necessary to change the direction of projection of the lamp to meet the user's lighting requirements.

Therefore, it is necessary to provide an angle adjustment mechanism for LED bar lighting which makes it possible to adjust the direction of projection of the LED bar lighting.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
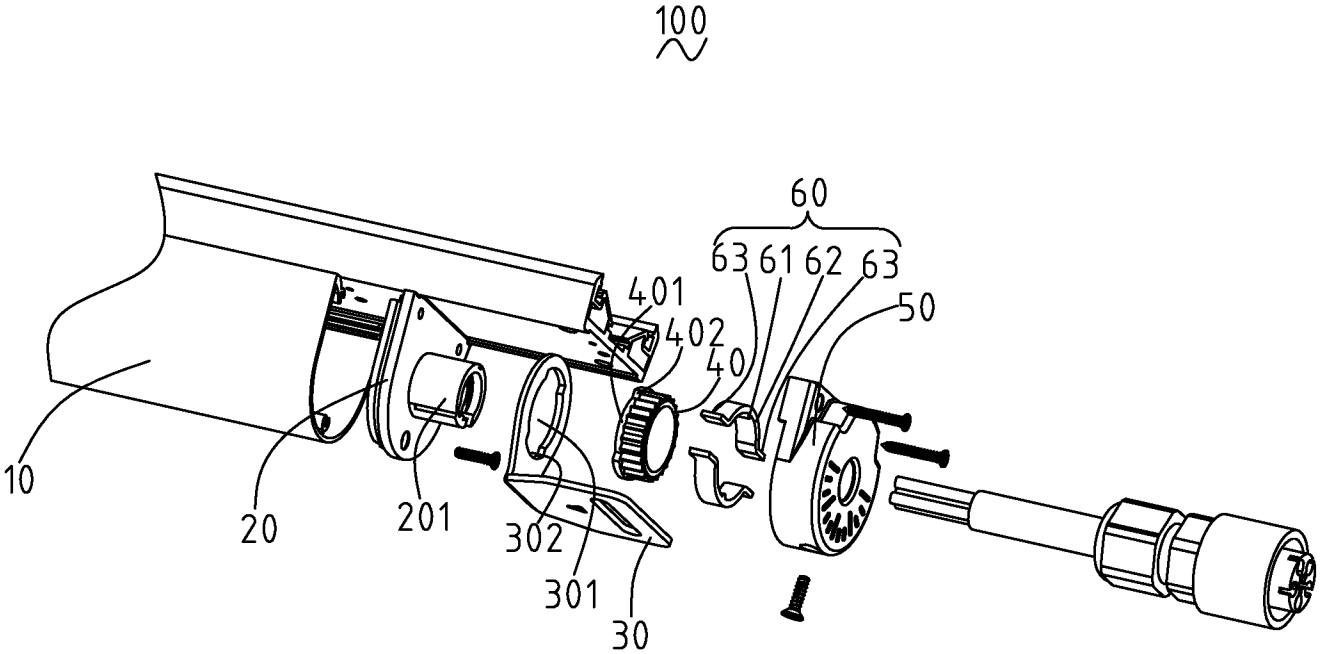
FIG. 1 is an explored view of an angle adjustment mechanism for LED bar lighting according to an embodiment.
Figure 2:
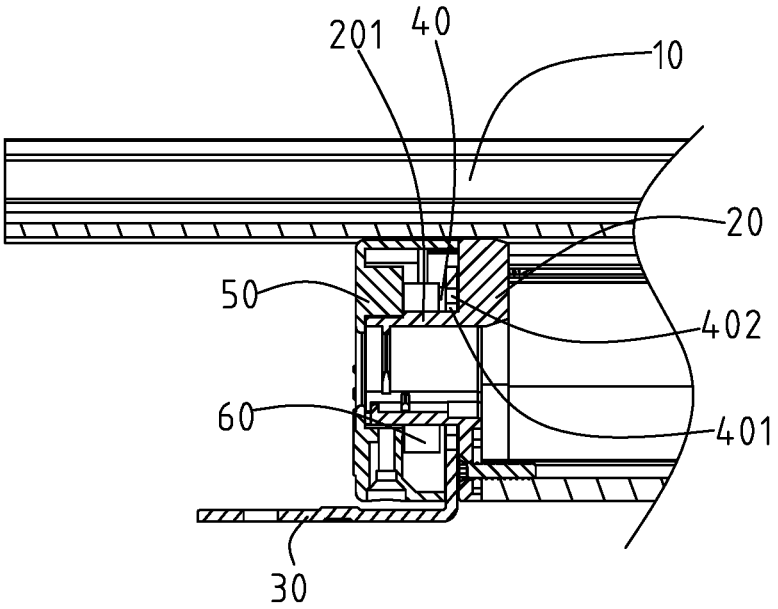
FIG. 2 is a cross sectional view of the angle adjustment mechanism for LED bar lighting of FIG. 1.
Figure 3:
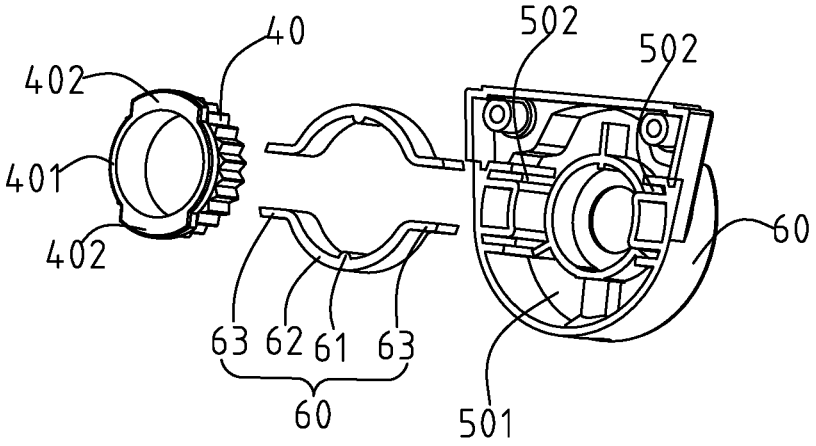
FIG. 3 is an explored view of a wheel gear, a stopping plate, an outer end cap of the angle adjusting mechanism for LED bar lighting of FIG. 1.

Referring to FIG. 1 to FIG. 3, an angle adjustment mechanism 100 for LED bar lighting is shown. The angle adjustment mechanism 100 for LED bar lighting includes a lamp body 10, two end covers 20 respectively mounted on two ends of the lamp body 10 along axial direction thereof, two lamp frames 30 respectively disposed on the two end covers 20, two wheel gears 40 fixed on the two lamp frames 30, two outer end caps 50 respectively fixed on the two end covers 20, and at least two stopping plates 60 respectively disposed in the two outer end caps 50. As well known for a person skilled in the art, the LED bar lighting further includes some other equipments, such as screws for fixing the positional relationship between all of structural members. In addition, the LED bar lighting further includes some lamp modules, such as LED chips, power source, lens, wires, and so on, which are well known for a skilled person and no need to describe in detail.

The lamp body 10 is configured for receiving some functional modules, such as circuit boards, wires, LED modules, lenses, or the like, and is also main structure for mounting the end caps 20, the outer end caps 50, or the like. The lamp body 10 may be a stripe and may be generally made of metal, such as aluminum alloy, for beautiful and heat dissipated.

It is to be further explained that the following end covers 20, the lamp frames 30, the wheel gears 40, and the outer end caps 50 have two components for matching the two axial ends of the lamp body 10 as the lamp body 10 has two axial ends along the axial direction thereof. The stopping plates 60 have at least two and are mounted in the outer end caps 50 respectively. For convenience of description and simplicity, only one of the above-mentioned modules as an example is illustrated in the drawings and the following descriptions.

The end covers 20 may be made via plastic injection molding as it has plurality of functions, such as clamping wires, mounting screws, water proofing, or the like. The two end covers 20 are respectively arranged two axial ends of the lamp body 10 by screws. Each of the two end covers 20 includes a threading pipe 201 extending therefrom along the axial direction of the lamp body 10. The threading pipe 201 has a through hole, and is configured for disposing the wires and installing the lamp frames 30, the wheel gears 40, and the outer end caps 50. The threading pipe 201 is provided on the other side with respect to the lamp body 10.

The lamp frames 30 are configured for installing the whole LED bar lighting onto a mounting surface and have an L-shaped structure. Each of the lamp frames 30 has two edges. One of the two edges is used to install the whole LED bar lighting, and the other is mounted on the threading pipe 201. Each of the lamp frames 30 includes a through hole 301 provided thereon for passing through the threading pipe 201, and at least one open 302 configured for fixing one of the two wheel gears 40. In order to increase strength, the lamp frames 30 are made of metal by stamping process, such as 304-stainless steel, or the like.

Each of the two wheel gears 40 is jacketed on the threading pipe 201 and located between the threading pipe 201 and the lamp frame 30. The gear teeth of the wheel gear 40 extend along the radial direction thereof and the wheel gear 40 is rotatable about the threading pipe 201. Since the gear teeth of the wheel gear 40 are provided along the radial direction thereof, the stopping plate 60 cooperates with the wheel gear 40 in the radial direction thereof so as to increase the coupling tightness therebetween and prevent from invalidating the angle adjustment mechanism 100 as the installation interval becomes larger. In order to fix the relative position between the wheel gear 40 and the lamp frame 30, each of the two wheel gears 40 includes a mounting portion 401 in one axial direction, and at least one ear 402 extending along the radial direction of the wheel gear 40. The mounting portion 401 is inserted into the through hole 301 of the lamp frame 30, and the ear 302 is received in the open 302 of the lamp frame 30. The through hole 301 and the open 302 are closely fitted with the mounting portion 401 and the ear 402 respectively so as to fix the relative position between the wheel gear 40 and the lamp frame 30. When the lamp frame 30 is rotated about the threading pipe 201, the lamp frame 30 can cause the wheel gear 40 to rotate together around the threading pipe 201. In the present embodiment, the wheel gear 40 has two ears 402 provided on opposite sides of the mounting portion 401, respectively. It may be understood that when the lamp frame 30 is fixed and the lamp body 10 is rotated, the wheel gear 40 will remain stationary with the lamp frame 30 together.

Referring to FIG. 3 together, the outer end cap 50 covers and is fixed on the end cover 20 by screws (not labeled) so that the whole LED bar lighting becomes more beautiful. A gap between the outer end cap 50 and the end cover 20 is formed so as to dispose the lamp frame 30. And as a result, the lamp frame 30 can extend out of the outer end cap 50 and the end cover 20. As shown in FIG. 3, the outer end cap 50 includes a receiving chamber 501. The threading pipe 201 and the wheel gear 40 are received in the receiving chamber 501. The outer end cap 50 further includes at least one pair of mounting grooves 502 which are arranged into the receiving chamber 501 and spaced apart from each other. The pair of mounting grooves 502 is configured for mounting the stopping plate 60. The two mounting grooves 502 may be provided on opposite sides of the threading pipe 201. Moreover, the specific locations of the two mounting grooves 205 need to be set in accordance with the structural characteristics of the stopping plate 60, which will be described in detail below as the stopping plate 60 is described.

The stopping plate 60 is disposed in the receiving chamber 501 of the outer end cap 50 and is configured for limiting or fixing the rotation position of the wheel gear 40 so that when the lamp frame 30 is fixed, the illumination direction of the lamp body 10 can be limited or fixed. Each of the two outer end caps 50 may have at least one stopping plate 60 disposed therein. Each of the stopping plate 60 includes at least one stopping tooth 61 which is coupled with the gear teeth of the wheel gear 40. It should be understood by those skilled in the art that in the art of gears, the above-mentioned "coupled" refers to various parameters such as tooth profile, modulus, tooth thickness, and the like of the stopping tooth 61 and the gear teeth of the wheel gear 40 are substantially same, so that the stopping teeth 61 can be closely engaged with the gear teeth of the wheel gear 40. The stopping plate 60 may be made of resilient material, such as plastic, thin metal sheet, and the like. When the outer end cap 50 drives the stopping plate 60 around the threading pipe 201 to rotate, the stopping plate 60 will be switched between the deformed state and the normal state and while the stopping teeth 61 is coupled to different gear teeth of the wheel gear 40 so that the angle adjustment of the light emitting direction of the lamp body 10 can be achieved. The stopping plate 60 may be a straight plate and fixed in the receiving chamber 501, and in detail, both ends of the straight plate may be slidably inserted in the receiving chamber 501. When the stopping plate 60 is deformed, it can slide along the mounting groove 502. In the present embodiment, the stopping plate 60 includes an arc-shaped portion 62, and two installation portions 63 arranged both ends of the arc-shaped portion 62 respectively. The two installation portions 63 can be slidably inserted into the mounting grooves 502 respectively. The arc-shaped portion 62 has same inner diameter with the outer diameter of the wheel gear 40 so that the stopping plate 61 can couple with the wheel gear 40.

The angle adjustment mechanism 100 of the LED bar lighting can adjust light emitting direction which has random angle according to the needs of users via the use of the wheel gear 40 having the gear teeth, the coupling of the stopping plate 60, and the relative fixing the lamp frame 30 and the wheel gear 40. Moreover, the angle adjustment mechanism 100 can avoid the failure of adjustment caused by wear and tear in use.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An angle adjustment mechanism for LED bar lighting, comprising:

a lamp body;

two end covers respectively arranged two ends of the lamp body along an axial direction thereof, each of the two end covers comprising a threading pipe extending along the axial direction of the lamp body;

two lamp frames respectively mounted on the two threading pipes;

two wheel gears respectively fixed on the two lamp frames, each of the two wheel gears comprising a plurality of gear teeth along a radial direction thereof and rotating around the threading pipe;

two outer end caps respectively fixed and covered on the two end covers; and at least two stopping plates respectively received in the two lamp frames, each of the stopping plates providing at least one stopping tooth which is coupling to the gear teeth.

2. The angle adjustment mechanism for LED bar lighting as claimed in claim 1, wherein the outer end cap comprises a receiving chamber, the threading pipe and the wheel gears are received in the receiving chamber.

3. The angle adjustment mechanism for LED bar lighting as claimed in claim 2, wherein the stopping plate is a straight plate and is fixed in the receiving chamber.

4. The angle adjustment mechanism for LED bar lighting as claimed in claim 3, wherein the outer end cap comprises two mounting grooves spaced apart from each other, the two ends of the straight plate are slidably inserted into the two mounting grooves, respectively.

5. The angle adjustment mechanism for LED bar lighting as claimed in claim 2, wherein the stopping plate comprises an arc-shaped portion, and two installation portions arranged both ends of the arc-shaped portion, respectively, the outer end cap comprises two mounting grooves spaced apart from each other, the two installation portions are slidably inserted into the two mounting grooves, respectively.

6. The angle adjustment mechanism for LED bar lighting as claimed in claim 1, wherein the stopping plate is made of resilient material.

7. The angle adjustment mechanism for LED bar lighting as claimed in claim 1, wherein the wheel gear comprises a mounting portion in one end thereof along an axial direction of the wheel gear, and at least one ear extending along the radial direction of the wheel gear, the lamp frame provides a through hole disposed on the mounting portion, and at least one open configured for receiving the ear.

8. The angle adjustment mechanism for LED bar lighting as claimed in claim 7, wherein the through hole and the open are closely fitted with the mounting portion and the ear respectively so as to fix the relative position between the wheel gear and the lamp frame.

9. The angle adjustment mechanism for LED bar lighting as claimed in claim 1, wherein since the gear teeth of the wheel gear are provided in the radial direction thereof, the stopping plate cooperates with the wheel gear in the radial direction thereof so as to increase the coupling tightness therebetween and prevent from invalidating the angle adjustment mechanism as the installation interval becomes larger.

10. The angle adjustment mechanism for LED bar lighting as claimed in claim 1, wherein when the outer end cap drives the stopping plate around the threading pipe to rotate, the stopping plate will be switched between the deformed state and the normal state and while the stopping teeth is coupled to different gear teeth of the wheel gear so that the angle adjustment of the light emitting direction of the lamp body can be achieved.

11. The angle adjustment mechanism for LED bar lighting as claimed in claim 1, wherein when the lamp frame is rotated about the threading pipe, the lamp frame causes the wheel gear to rotate together around the threading pipe.

* * * * *